United States Patent [19]

Briner et al.

[11] 4,426,836

[45] Jan. 24, 1984

[54] SPINNING PREPARATORY MACHINE

[75] Inventors: Emil Briner; Peter Novak, both of Winterthur; Hermann Gasser, Frauenfeld, all of Switzerland

[73] Assignee: Rieter Machine Works Limited, Winterthur, Switzerland

[21] Appl. No.: 261,152

[22] PCT Filed: Sep. 3, 1980

[86] PCT No.: PCT/EP80/00090

§ 371 Date: May 28, 1981

§ 102(e) Date: Apr. 20, 1981

[87] PCT Pub. No.: WO81/00867

PCT Pub. Date: Apr. 2, 1981

[30] Foreign Application Priority Data

Sep. 28, 1979 [CH] Switzerland ..... 8766/79

[51] Int. Cl.[3] ..... D01H 9/04

[52] U.S. Cl. ..... 57/267; 57/67; 57/276

[58] Field of Search ..... 57/266, 267, 67, 71, 57/96, 276, 277

[56] References Cited

U.S. PATENT DOCUMENTS

| | | | |
|---|---|---|---|
| 1,590,865 | 6/1926 | Stell et al. | 57/267 |
| 3,380,238 | 4/1968 | Araki et al. | 57/267 |
| 3,935,699 | 2/1976 | Iida et al. | 57/267 |

*Primary Examiner*—John Petrakes

*Attorney, Agent, or Firm*—Werner W. Kleeman

[57] ABSTRACT

The invention concerns a spinning preparatory machine with suspended pivotable flyers arranged in at least one row. The flyers are supported in a frame composed of a longitudinal beam and two arms and arranged at right angles thereto, which frame is pivotable about a pivoting axis between an operating position and a doffing position. A pivoting and loading system is connected with the frame in such a manner that the frame is locked in its operating position.

The spinning preparatory machine according to the invention shows, among others, the advantage of an accurate positioning of the pivotable flyers in a locked operating position, high operational reliability and affords safety against accidents from occurring.

9 Claims, 9 Drawing Figures

SPINNING PREPARATORY MACHINE

CROSS REFERENCE TO RELATED CASE

This application is related to the commonly assigned, copending U.S. application Ser. No. 06/261,153, filed Apr. 20, 1981, now U.S. Pat. No. 4,375,744, entitled "APPARATUS FOR CONTROLLING THE ROTATIONAL SPEED OF THE SPINDLES OF A SPINNING PREPARATORY MACHINE", and listing as the inventors EMIL BRINER et al.

BACKGROUND OF THE INVENTION

The present invention concerns a spinning preparatory machine (or roving frame) containing a machine frame and spindles arranged therein in at least one row and with flyers suspended thereabove and pivotable about a common, virtual or imaginary longitudinal axis of the machine between an operating position and a doffing position where the bobbins can be unobstructedly upwardly doffed from the spindles.

A spinning machine of this type is described, e.g. in the commonly assigned, copending U.S. application Ser. No. 06/243,947, filed Mar. 10, 1981, now U.S. Pat. No. 4,389,840.

The pivotability of the flyers in a spinning preparatory machine of this type, also called roving or fly frame, decisively improves the operability of the machine, particularly the bobbin doffing and donning operation.

As the flyers can be pivoted away above the spindles it is possible to doff the completed bobbins, placed on the spindles, in vertical direction and to remove them from the spindles, and also to donn new, empty bobbins in vertical direction onto the spindles. This facilitates the doffing and donning operation for the operators, if this operation is to be effected manually, or, respectively, renders automation of this operation feasible, as explained in detail in the above mentioned U.S. application Ser. No. 06/243,947.

SUMMARY OF THE INVENTION

It is an important object of the present invention to provide for a spinning preparatory machine of the type initially mentioned, a design of the elements supporting and pivoting the flyers of a row, in which:

1. Positioning of all flyers of a row vertically above the spindles is effected and maintained precisely and securely;
2. Pivoting of all flyers of a row is effected absolutely symmetrically, i.e. absolute parallelity of all flyers of a row is maintained;
3. The operating position of the flyers is self-locking, i.e. the flyers of the whole row are maintained securely in this position also in case of an electrical power failure;
4. Vibrations of the flyers, particularly during operation, i.e. while the flyers are in their operating position, are avoided;
5. The supporting and pivoting elements of the row of flyers are designed as advantageously as possible with respect to the prevailing forces, in other words these elements are relieved of the forces or loads as far as possible. This relates particularly to the longitudinal elements (i.e. the elements extending in the longitudinal direction) of the machine.

This object is achieved in a spinning preparatory machine of the type mentioned above, in that the flyers of a row are supported in a frame which comprises a longitudinal beam and at least two arms arranged at right angles thereto, which at their free end are supported in the machine frame so as to be pivotable about a pivoting axis. In their operating position the arms are pressed against a first stop provided on the machine frame by at least one pivoting and loading system containing a spring. The pivoting and loading system is kinematically connected to the machine frame in such manner that in the operating position it is brought into a locked position where the loading pressure is lower, after passing a labile or unstable position in which the loading pressure is maximum.

The desired self-locking action in the operating position of the frame supporting the flyers of a row is achieved in that the frame passes a labile or unstable position. This ensures high operational reliability and security against accidents for the operators working at the machine. The frame supporting the flyers in its operating position is always pressed by spring pressure load against a first stop provided on the machine frame, and thus the accurate positioning of all flyers of a row is ensured, the occurrence of vibrations in this position is avoided, and the longitudinal elements are relieved from forces or loads. Support or mounting of the flyers of a row in a frame, as contemplated, ensures also for the symmetric positioning of all flyers in a row, and there is maintained absolute mutual parallelity.

Further advantages of the present invention are hereinafter described in connection with the description of various preferred exemplary embodiments.

BRIEF DESCRIPTION OF THE DRAWINGS

The invention is described in greater detail in the following description with reference being made to illustrated exemplary embodiments, wherein.

DETAILED DESCRIPTION OF THE PREFERRED EMBODIMENTS

Figure 1:
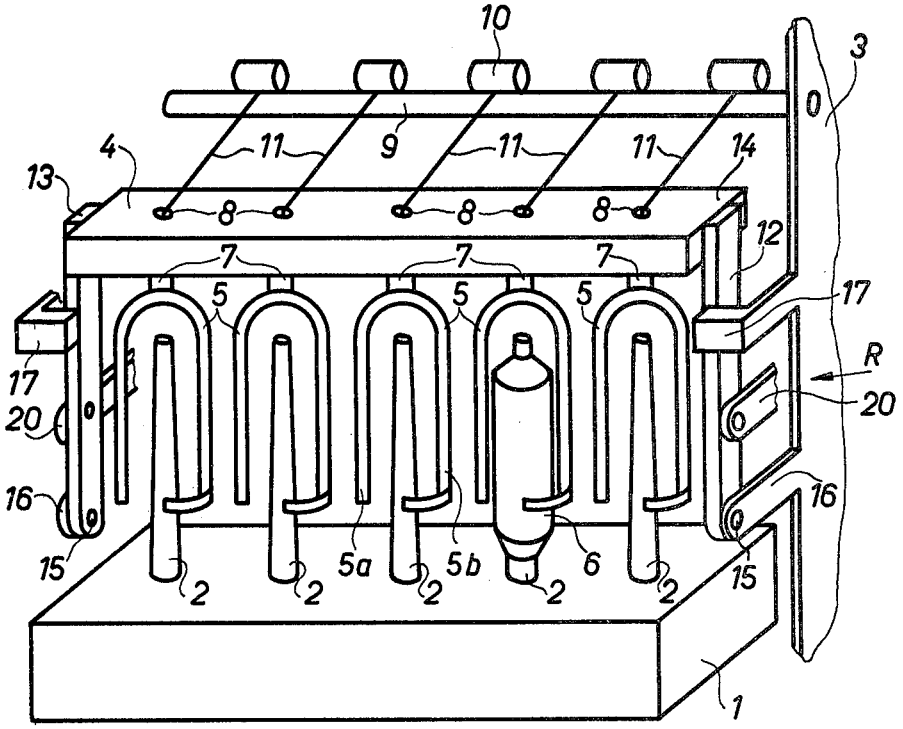
FIG. 1 is a schematic, axonometric view of a section of the inventive spinning preparatory machine, wherein to simplify the illustration there have only been shown the elements essential for understanding the invention.

In FIG. 1 the spindle rail of a spinning preparatory machine is indicated by reference number 1. The spindle rail 1 supports spindles 2 arranged at regular intervals in a row along the rail 1, the spindles 2 being driven in a manner known as such, the driving means therefore not being particularly shown. The spindle rail 1 is guided in a manner known as such in the machine frame 3 by vertical guides not shown, and is moved up and down along the guides by means not shown.

Above the spindle rail 1, flyers 5, driven by means not here shown, but which drive means may be constructed and arranged as disclosed in the aforementioned U.S. application Ser. No. 06/243,947, are supported in a longitudinal beam 4, which flyers 5, as known likewise from the above mentioned copending U.S. application Ser. No. 06/243,947, are pivotable about a common, virtual longitudinal axis of the machine between an operating position, in which they rotate coaxially with the corresponding spindles 2, and a doffing position, in which the bobbins (one bobbin 6 only being shown) can be doffed unobstructedly upward from the spindles 2.

The shafts or axes 7 of the flyers 5 in this arrangement are hollow, in such a manner that between the upper portion of the longitudinal beam 4 and the flyers 5 there are provided through bores or passages 8 for the roving 11 emerging from a drafting arrangement, known as such, the delivery rolls 9 and 10 of which are only shown. The rolls of the drafting arrangement extending throughout the machine, such as e.g. the bottom roll 9, are supported in the machine frame 3 in a manner known as such.

The longitudinal beam 4 is connected at both its ends with a respective arm 12 and 13, arranged at right angles thereto, the beam 4 and the arms 12, 13 forming a rigid frame or frame means 14. At their free ends the arms 12 and 13 are pivotably supported on a related pivoting axis or shaft 15 in the machine frame 3. In this arrangement the machine frame 3 is provided with an extension 16; the shape of the machine frame 3, however, obviously can be chosen as desired.

The shafts or axes 15 of both arms 12 and 13 coincide i.e., are in alignment with one another and form the virtual longitudinal axis of the machine about which the flyers 5 of a row of flyers can be pivoted from their operating position into their doffing position.

Furthermore, the machine frame 3 contains a related stop 17 for each of the arms 12 and 13, respectively, by means of which there is determined the operating position of the frame 14, and thus, of the flyers 5. In FIG. 1 the frame 14 is shown in the operating position, in which the arms 12 and 13 are pressed against the stops or stop means 17.

In this position the spindles 2 and the flyers 5 rotate about their axes, and the delivery rolls 9, 10 of the drafting arrangement deliver rovings 11 to each spinning position. Winding of the roving onto each bobbin 6 due to the coaction of the spindle 2 and the flyer 5 is well known as such, and thus any further description of this process can be dispensed with.

It should be noted, however, that all flyers 5 of a row are mutually parallel at all times (i.e. that the planes containing both legs 5*a* and 5*b* of each flyer 5 are all mutually parallel to one another), and that their stop position is chosen such that their pivoting in conjunction with the frame 14 is effected as described in the aforementioned U.S. application Ser. No. 06/243,947.

Pressing the arms 12 and 13 against the corresponding stop 17 and pivoting the frame or frame means 14 from the operating position into the doffing position now are effected by the inventive pivoting and loading system, to be explained in greater detail with reference to FIGS. 2 and 3*a* through 3*c*.

Figure 2:
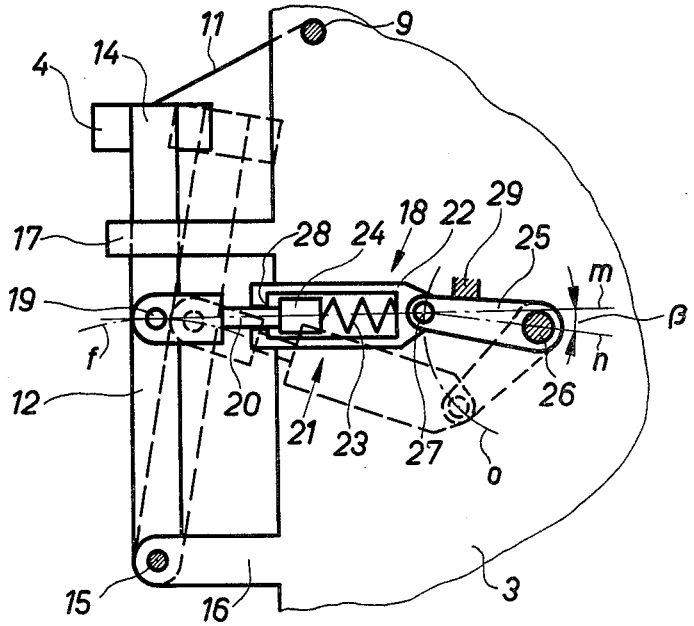
FIG. 2 is a side view (looking in the direction of the arrow R of FIG. 1) of a part of the spinning preparatory machine according to FIG. 1 and containing a pivoting and loading system.

In FIG. 2, where the spinning preparatory machine according to FIG. 1 is shown as viewed from the side looking in the direction of the arrow R depicts, a first embodiment of the pivoting and loading system 18 for the frame 14.

At any desired point of the frame 14, e.g. at a point of the arm 12, there is linked or pivotably connected by means of a pivot pin or shaft 19 the piston rod 20 of a spring loaded cylinder and piston system 21. Inside the cylinder 22 there is arranged a pre-biased pressure spring 23 which constantly exerts a pressure force upon the piston 24. The cylinder 22 at its end opposite to the piston rod 20 is linked, or pivotably connected by means of a pivot pin or shaft 27 defining a pivot axis with the crank 25 of a crankshaft 26 which is rotatably supported in the machine frame 3.

In FIG. 2 the operating position of the frame 14 is indicated with solid lines, whereas the pivoted-back doffing position is indicated with broken or phantom lines, and in which doffing position the bobbins 6 can be vertically upwardly doffed from the spindles 2. Furthermore, a curve designated f indicates the path which is described by the centre of the pivot pin or axis 19 as the frame 14 is pivoted about the pivoting shafts 15 defining a pivoting axis. This curve f is an arc with its centre at the pivoting axis.

The arrangement of the pivot shafts 15 and 27 fixed in the machine frame 3 with respect to the room or space, as well as the dimensions of the various lever arms (i.e. the distances between the pivot shaft 15 and the pivot shaft or axis 19 in the related arm 12, between the axis 19 and the axis 27 in the cylinder and piston system, and the length of the crank 25), and the position of the first stop or stop means 17 in this arrangement are chosen such, that in the operating position of the frame 14 the following two conditions are fulfilled:

(a) The connecting line m between the centres of the axes 19 and 27 forms an acute angle $\beta$ with the connecting line n between the centres of the crankshaft 26 and axis 27.

(b) The piston 24 is freely movable in the cylinder 22, i.e. it does not rest against the stop 28 of the cylinder 22; this means, that in this position the full spring force of the spring 23 is transmitted via the piston rod 20 onto the arm 12, and thus, onto the frame 14: the frame 14 thus is pressed always against the stop means 17. As the action line m of the spring force forms an acute angle $\beta$ with the connecting line n, the reaction force of the pressure load exerts a clockwise moment upon the crank 25 of the crankshaft 26. This moment can be taken up in that the shaft 26, in this position, is blocked against further clockwise rotation. According to a preferred embodiment of the inventive spinning preparatory machine, however, a second stop 29 is provided which is arranged on the machine frame and against which the crank 25 is pressed in such a manner that its further clockwise rotation is prevented.

This arrangement presents the advantage that the clockwise moment or torque exerted upon the crank 25 is not transmitted to the crankshaft 26, but is counteracted via the stop 29 by the machine frame 3. This permits a welcome relief of forces on the crankshaft 26 in the operating position of the frame 14, which is of particular importance, if, as it frequently occurs in practical application, the machine contains a large number of spindles.

In such cases the machine is sub-divided into sections, each only containing a small number of spindles the sections being separated by the walls of the machine frame 3: the forces thus are transmitted to the different intermediate walls of the machine frame 3, whereas the crankshaft 26 extending throughout the machine is not subjected to any torque load during the operation phase, which in time is much longer than the pivoting phase.

It should be noted, that the expression "cylinder and piston system" is not to be understood in the sense of pneumatics. The cylinder 22 merely forms a straight guide for the piston 24 onto which acts the pressure force of the spring 23. Choosing a closed cylinder 22 as a guide element merely presents advantages for the design since then particularly the guide elements and the piston 24 and the spring 23 are well protected from external influences (such as e.g. fly deposits, etc.); other mechanisms, however, also can be considered providing the same function in the same manner as the cylinder and piston system, such as e.g. open guide elements, and can be utilized within the scope of the present invention.

In FIG. 2, the doffing position of the frame 14 is indicated with broken lines as well as the corresponding position of the pivoting and loading system 18: by rotation of the crankshaft 26 in counter-clockwise direction the crank 25 is moved along the arced path o, such that the cylinder and piston system or unit 21 moves the axis 19 along the line f in clockwise direction and effects the pivoting of the frame 14. During this movement of the pivoting and loading system 18 it should be obvious that the piston 24 in the cylinder 22 first is moved up to the stop 28 in the cylinder 22 under the influence of the spring 23 from the right-hand side to the left.

Figure 3D:
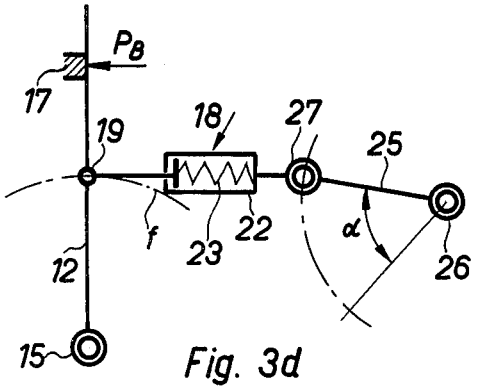
FIGS. 3*a* to 3*d* illustrate the pivoting and loading action and FIG. 3*e* is a diagram showing the characteristic of the pressure load P during the pivoting movement of the frame.
Figure 3E:
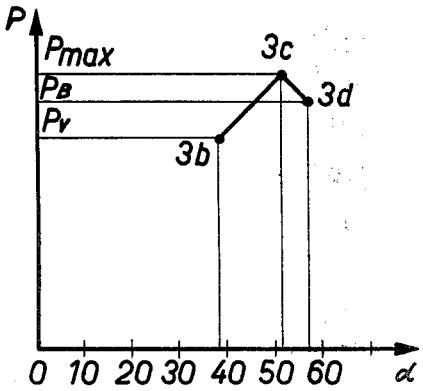
Figure 3C:
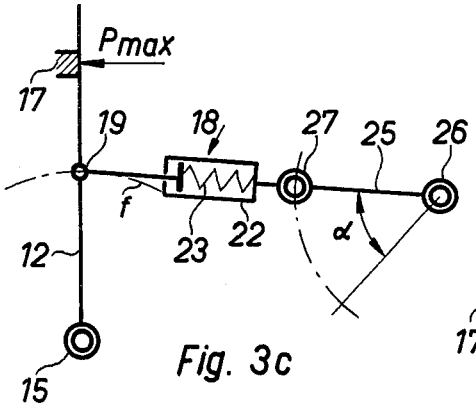
Figure 3B:
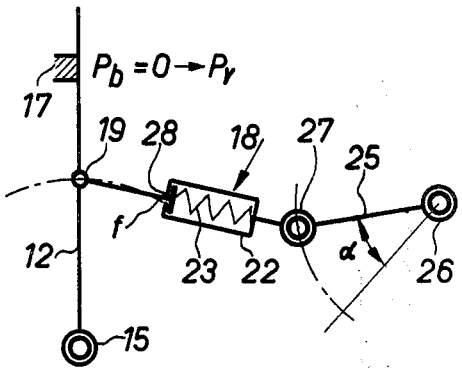
Figure 3A:
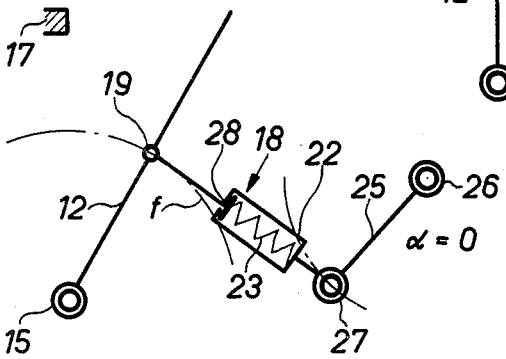

In FIGS. 3*a* through 3*d* the pivoting and loading action is shown with reference to a simplified illustration of the lever mechanism described. In FIG. 3*a* the frame 14, or the arm 12, respectively, is shown in its doffing position; the crank 25 has been brought into position shown, which in this context is called the starting position of the pivoting movement and is characterized by the angle $\alpha=0$ ($\alpha$ being the angle between the position of the crank 25 at the start of the pivoting movement and its momentary position during the movement). The frame does not rest against the stop means 17, so that the pressure load in this position is zero. The spring 23, however, presses the piston 24 (FIG. 2) of the loading system 18 against the stop 28, namely with a pressure force, which corresponds to the pre-tensioning force of the spring 23.

As shown in FIG. 3*b* the crank 25 now has been rotated over an angle $\alpha$ of about 38 degrees in clockwise direction: in this position the arm 12 just contacts the related stop 17, in such manner that the pressure load $P_b$ still equals zero. Any further rotation, however small, of the crank 25 in clockwise direction causes compression of the pressure spring 23, i.e. the piston 24 (FIG. 2) is lifted off the stop 28 of the cylinder 22 and the full pre-tension force of the spring 23 is transmitted onto the pivot shaft or axis 19 of the arm 12. Now the pressure load $P_v$ acts against the stop 17, which load force is equal to the pre-tension force of the spring multiplied by the length ratio of the lever arms. Stated in other words, at the angle $\alpha \cong 38°$ the pressure load against the stop 17 abruptly increases from zero to the value $P_v$, whereupon any further rotation of the crank 25 in clockwise direction causes an increase of the pressure load P, corresponding to the characteristic of the spring 23. The charcteristic of the pressure load P as a function of the angle $\alpha$ is plotted in FIG. 3*e*.

In FIG. 3*c* the position of the pivoting and loading system 18 is shown, in which the axes 19, 27 and the crankshaft 26 are arranged in a straight line, the angle $\alpha$ in this case being about 51°. In this position the pressure spring is compressed to a maximum, i.e. the pressure load P reaches the maximum value $P_{max}$ at $\alpha \cong 51°$. This position is an unstable position of the system, as the pressure load P now decreases whether the crank 26 rotates further clockwise or counter-clockwise.

In FIG. 3*d* there is now shown the operating position of the frame 14 and the arm 12, respectively, and that of the pivoting and loading system 18. The crank 25 has been rotated further clockwise with respect to the position shown in FIG. 3*c* into an angle $\alpha$ of about 58°: the pressure load correspondingly has decreased from the value $P_{max}$ to the value $P_B$. The system again has become stable, since the spring force of the spring 23 now definitely tends to rotate the crank 25 further in clockwise direction. The position according to FIG. 3*d* thus constitutes a locking position of the pivoting and loading system 18, since the frame 14 can be brought back from this operating position to the doffing position (FIG. 3*a*) only under application of an outer force and under passing an unstable position (FIG. 3*c*).

Figure 4:
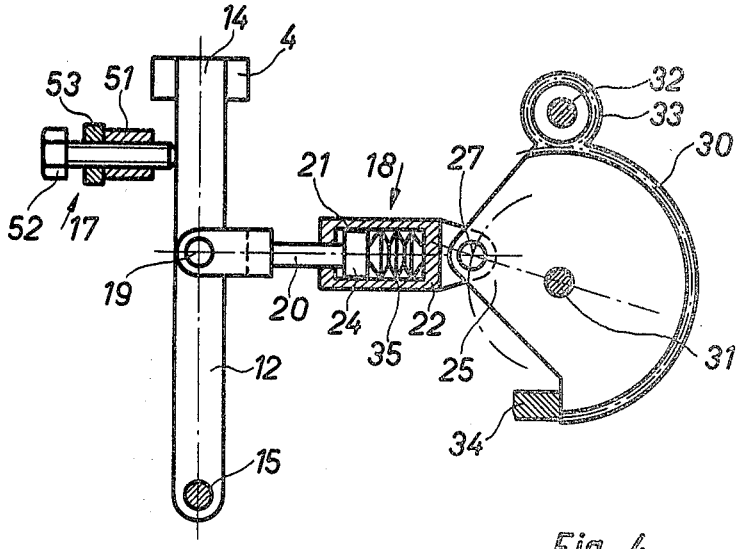
FIG. 4 is a further design example of the pivoting and loading system presented in the same view as shown in FIG. 2.

In FIG. 4 an alternative design example of the pivoting and loading system 18 is shown, which presents advantages concerning the handling of forces. The same elements as shown in the arrangement according to FIGS. 1 and 2 are here again generally designated with the same reference numbers. This arrangement differs from the one shown in the previous Figures in that here the crank 25 is part of a toothed segment 30. The position of the axes 19, 27 and 31 exactly corresponds to that of the exemplary embodiment described heretofore, in such manner that this apparatus functions in exactly the same manner. The toothed segment 30 which is supported to be rotatable about an axis or shaft 31 fixed in the machine frame (not shown) is driven in either direction by a toothed pinion 33 mounted on a longitudinal shaft 32, which also is rotatably supported at a fixed point of the machine frame (not shown). By suitably choosing the gearing ratio between the pinion 33 and the toothed segment 30, the torque or moment to be transmitted for the pivoting movement (and particularly for overcoming the unstable position) via the longitudinal shaft 32, which preferably extends over the whole machine side, is reduced in such a manner, that it can be constructed lighter. Furthermore, this reduction of forces permits use of relatively soft, but noise-reducing and maintenance-reducing materials for the pinion 33, such as plastics, particularly if, as shown in FIG. 4, the toothed segment 30 in the operating position is secured against further clockwise rotation by a stop 34 (the function of which corresponds to that of the stop 29 shown in FIG. 2). In this case the stop 34 bears the torque or moment exerted by the loading system 18 onto the toothed segment 30 while the operating position is maintained over a very long time, in such a manner that the pinion 33 and the longitudinal shaft 32 are relieved and are used merely during the pivoting action.

In FIG. 4 furthermore it is shown that in the cylinder and piston system 21 there can be advantageously used a stack of bevelled springs 35 as a spring. This type of spring which is known as such is well suited for use within the scope of the present invention owing to its stiff characteristic, since relatively small spring deformations are encountered.

Figure 5:
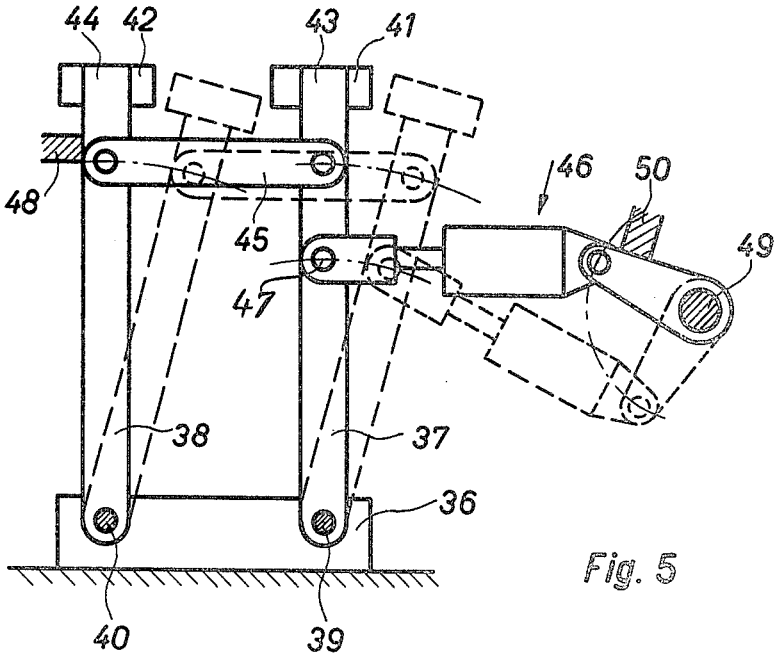
FIG. 5 is an alternative design example of the inventive spinning preparatory machine with two rows of flyers, shown in a side view corresponding to the view shown in FIG. 2.

In FIG. 5 an alternative embodiment of the inventive spinning preparatory machine is shown, in which, as frequently encountered in practise, two parallel rows of flyers are provided, each row of flyers being supported in a pivotable frame.

In FIG. 5, showing a schematic view of the spinning preparatory machine with two rows, as seen in the direction of the arrow R according to FIG. 1, the machine frame is designated by reference number 36, in which machine frame 36 the two arms 37 and 38 are rotatably supported on the corresponding pivoting axes or shafts 39 and 40. The arms 37 and 38 each form, with a longitudinal beam 41 and 42 and with an arm which is not visible, two frames 43 and 44, in the longitudinal beam 41 and 42 respectively, of which the flyers (not shown) are supported and driven. According to the invention, both frames 43 and 44 are interconnected by a connecting element 45 in such manner that they always remain parallel, which is achieved as e.g. shown in FIG. 5, in that the length of the connecting element 45 is chosen equal to the distance between the pivoting axes or shafts 39 and 40, in the sense of a parallel guide system.

Within the scope of the invention, however, any connecting method can be considered, by means of which the frames 43 and 44 are maintained parallel. For a spinning preparatory machine of this type, according to the invention, a common pivoting and loading system 46 is provided for both rows of flyers, and for both frames 43 and 44, respectively, which can be chosen exactly the same as shown in the design example according to FIG. 1, such that detailed description can be dispensed with here.

The advantage of this solution is seen in the simplicity of the pivoting and loading system.

Further advantages can be achieved using the spinning preparatory machine described here, if, as shown also in FIG. 5, the pivoting and loading system 46 is connected with the frame 43 of one row of flyers, above the pivot shaft or axis 47, whereas the frame 44 of the other row of flyers is pressed against the first stop 48. This solution presents the advantage that the flow of forces generated by the spring (not shown) of the pivoting and loading system 46 extends over all the linkage points between the first stop 48 and the crankshaft 49 or the stop 50, respectively, if such is provided, in such a manner that the whole system of the two frames 43 and 44 in its operating position (shown with solid lines in FIG. 5) is constantly kept under pressure load. This prevents any vibration of the individual parts of the two-frame system.

In FIG. 5 furthermore, the doffing position of the frames 43 and 44 is indicated with broken lines.

In FIG. 4 it is further shown in which manner the first stop 17 determines the operating position of the flyers and is designed to be adjustable in accordance with a further preferred embodiment of the invention: a very simple possibility of achieving the desired adjustability consists in designing the stop 17 as a screw 52 which can be screwed into a fixed support 51. The screw 52 is fixed in its position by a counternut 53.

While there are shown and described present preferred embodiments of the invention, it is to be distinctly understood that the invention is not limited thereto, but may be otherwise variously embodied and practiced within the scope of the following claims. Accordingly,

What we claim is:

1. A spinning preparatory machine comprising:
a machine frame;
a plurality of spindles arranged at said machine frame in at least one row;
a plurality of flyers suspended above said row of spindles and pivotable about a common virtual longitudinal axis of the machine between an operating position and a doffing position where the bobbins can be doffed without obstruction upwardly from the spindles;
frame means for supporting the flyers in a row;
said frame means comprising a longitudinal support beam and at least two arms arranged essentially at right angles to said longitudinal support beam;
said at least two arms each having a free end;
said machine frame supporting said at least two arms at their free ends so as to be pivotable about a pivot axis;
first stop means provided for the machine frame;
at least one pivoting and loading system for pressing said at least two arms in an operating position thereof against said first stop means;
said pivoting and loading system containing a spring; and
means for kinematically connecting the pivoting and loading system with the frame means and with the machine frame in such a manner that in an operating position of the frame means the pivoting and loading system can be brought into a locking position, after passing an unstable position where the loading pressure is greatest, and in which locking position the loading pressure is lower.

2. The spinning preparatory machine as defined in claim 1, wherein:
said pivoting and loading system comprises a spring-loaded piston and cylinder system;
said frame means having a fixed point;
said spring-loaded piston and cylinder system being hingedly connected at one side thereof with said fixed point of said frame means;
a crankshaft containing a crank and rotatably supported in said machine frame; and
said spring-loaded piston and cylinder system being hingedly connected at another side thereof with said crank of said crankshaft.

3. The spinning preparatory machine as defined in claim 2, wherein:
said crank is formed by part of a toothed segment.

4. The spinning preparatory machine as defined in claim 2, wherein:
said machine frame contains a second stop means; and
said crank resting against said second stop means when said frame means is in its operating position.

5. The spinning preparatory machine as defined in claim 4, wherein:
said crank is formed by part of a toothed segment;
said toothed segment resting against said second stop means of the machine frame when said frame means is in its operating position.

6. The spinning preparatory machine is defined in claim 2, further including:
a stack of bevelled plate springs for loading said piston and cylinder system.

7. The spinning preparatory machine as defined in claim 1, wherein:
two parallel rows of said flyers are provided;
said frame means comprising a respective pivotable frame for each row of flyers;
a connecting member for interconnecting said two pivotable frames in a manner such that said pivotable frames always remain substantially mutually parallel to one another; and said pivoting and loading system defining a common pivoting and loading system for both of said pivotable frames.

8. The spinning preparatory machine as defined in claim 7, wherein:

said pivoting and loading system being connected with the frame of one of said rows of flyers; and the frame of the other row of flyers being pressed against said first stop means.

9. The spinning preparatory machine as defined in claim 1, wherein:

said first stop means comprises an adjustable stop and determines the operating position of said flyers.

* * * * *